US007140279B2

(12) United States Patent
Hernandez, Jr.

(10) Patent No.: US 7,140,279 B2
(45) Date of Patent: Nov. 28, 2006

(54) DUAL-HEADED PLIERS AND METHOD OF MANUFACTURE

(75) Inventor: Hector Ray Hernandez, Jr., Fullerton, CA (US)

(73) Assignee: AllTrade Tools LLC, Long Beach, CA (US)

( * ) Notice: Subject to any disclaimer, the term of this patent is extended or adjusted under 35 U.S.C. 154(b) by 176 days.

(21) Appl. No.: 10/915,802

(22) Filed: Aug. 11, 2004

(65) Prior Publication Data

US 2006/0032344 A1 Feb. 16, 2006

(51) Int. Cl.

| | |
|---|---|
| ***B25B 7/00*** | (2006.01) |
| *B25B 7/02* | (2006.01) |
| *B25B 7/22* | (2006.01) |

(52) U.S. Cl. ..... 81/427.5; 81/303; 81/423; 7/127

(58) Field of Classification Search ..... 81/427.5, 81/303, 311, 305, 423; 7/107, 118, 127–129; D8/52, 55, 58

See application file for complete search history.

(56) References Cited

U.S. PATENT DOCUMENTS

| | | | | |
|---|---|---|---|---|
| 2,651,227 | A | 9/1953 | Kennington | |
| 5,245,721 | A | 9/1993 | Lowe et al. | |
| 6,023,805 | A | 2/2000 | Lin | |
| 6,223,374 | B1 * | 5/2001 | Lin | 7/127 |
| D470,734 | S * | 2/2003 | Budrow | D8/55 |
| 6,647,835 | B1 * | 11/2003 | Tseng | 81/423 |
| 6,721,983 | B1 * | 4/2004 | Dallas et al. | 7/128 |
| D494,825 | S * | 8/2004 | Hernandez | D8/52 |
| 6,786,117 | B1 * | 9/2004 | Tseng | 81/303 |
| 6,834,571 | B1 * | 12/2004 | Lowe et al. | 81/427.5 |

* cited by examiner

*Primary Examiner*—Lee D. Wilson
*Assistant Examiner*—Alvin J. Grant
(74) *Attorney, Agent, or Firm*—John J. Connors; Connors & Assoc. Inc.

(57) ABSTRACT

Pliers having, for example, needle-nose and blunt-nose heads are manipulated using handles connected to pivot and move between a needle-nose head, grip-ready, position and a blunt-nose head, grip-ready, position. Each handle has a stop member having two faces. One face of each stop member is adapted to abut a needle-nose head and the other face is adapted to abut a blunt-nose head.

38 Claims, 11 Drawing Sheets

DUAL-HEADED PLIERS AND METHOD OF MANUFACTURE

INCORPORATION BY REFERENCE

The inventor incorporates herein by reference any and all U.S. patents, U.S. patent applications, and other hard copy or electronic documents cited or referred to in this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

"Rectangular shape" includes square shape

BACKGROUND OF INVENTION

In many industries tools include two or more functions. An example of such a tool is a dual-headed pliers which include two pairs of jaws for providing multiple jaw tool functions. One type of dual-headed pliers include a single pair of free-swinging handles for actuating both pairs of jaws with a biasing spring for positioning those jaws to a preferred position for use. Examples of dual-headed pliers are disclosed in U.S. Pat. Nos. 5,245,721 and 6,023,805.

SUMMARY OF INVENTION

This invention has one or more features as discussed subsequently herein. After reading the following section entitled "DETAILED DESCRIPTION OF SOME EMBODIMENTS OF THIS INVENTION," one will understand how the features of this invention provide its benefits. The benefits of this invention include, but are not limited to: low cost manufacture, ease of assembly, and convenience of use.

Without limiting the scope of this invention as expressed by the claims that follow, some, but not necessarily all, of its features are:

One feature of the dual headed pliers of this invention is that first and second gripping heads are moveable by a pair of handle members between a first position where the first head is positioned to grip an object and the second head is between the handle members and a second position where the second head is positioned to grip an object and the first head is between the handle members. One head includes a first pair of jaws spring biased into a normally opened predetermined position. The other head includes a second pair of jaws spring biased into a normally opened predetermined position. In the normally opened predetermined position the individual jaws of each head may be separated a distance that is no greater than about 2.0 inches, for example from about 1 to about 2 inches. Each jaw has an external non-gripping edge.

A second feature is that the handle members are free-swinging. Each handle member may rotate independently about a pivot member and each handle member may be substantially linear and symmetrical about its longitudinal axis. The handle members each have a free end and a connector end attached to the pivot member. Each handle member may have a length that is from about 4 to about 9 inches and they each may have substantially equal lengths. In the one embodiment, each handle member may include a top flat panel and a bottom flat panel that cover most of the jaws of the head positioned between the handle members. These top and bottom panels may be substantially parallel and spaced apart a distance from about ¼ to about 1 inch. In an alternate embodiment, at least one of the handle members may have only a single panel, or is otherwise constructed, to provide an open segment that enables at least a portion of the head (typically most of one jaw) seated between the handle members to be exposed to view by a prospective purchaser. The single flat panel member of one handle member may be on an opposite handle side with respect to the single panel member of the other handle member. This alternate embodiment is most suitable to be enclosed within packaging having a transparent section enabling the prospective purchaser to see and readily notice that a pair of pliers heads, each of a different shape, are provided by this embodiment of the invention.

A third feature is a stop member for each handle member. The stop members are at an intermediate portion of each handle member. Each stop member has one side comprising a first face and another side comprising a second face. The first and second faces of the stop member of each handle member merge at a junction to form a corner having planar surfaces that intersect to form an angle from about 30 to about 90 degrees. The sides forming the faces are substantially at a right angle to one or both panels forming the handle member. In the first handle position, the first faces of each stop member of each handle member engage the external non-gripping edges of each jaw of the second head. In the second handle position, the second faces of each stop member of each handle member engage the external non-gripping edges of each jaw of the first head. Each stop member may comprise a stack of flat plate members (also referred to as planar elements) with each plate member having substantially an identical shape, for example, a five-sided polygon shaped. One side comprises the first face and another side comprises the second face. The stop members are sized, shaped and respectively positioned on each handle member to be mirror images of each other.

A fourth feature is that each longitudinal axis of the handle members. Each axis may serve as a reference line extending between the corner junction and the pivot member about which the handle members rotate. Each reference line intersects the corner junction to form a first acute angle between the first face and the longitudinal axis and a second acute angle between the second face and the longitudinal axis. The both the first and second acute angles may be from about 15 to about 75 degrees, but one acute angle is greater than the other acute angle. The first faces, when engaging individually one of the non-gripping edges of the jaws of the second gripping head, each slope substantially in the same general direction as the non-gripping edge that the individual first face engages. Similarly, the second faces, when engaging individually one of the non-gripping edges of the jaws of the first gripping head, each slope substantially in the same general direction as the non-gripping edge that the individual second face engages.

A fifth feature is the normally open positions of the jaws of each gripping head. Due to the spring biasing of the gripping heads, their jaws are in a normally opened predetermined position, unless manually pressed together to overcome the basing action of the spring. With the jaws of the first gripping head in a normally opened predetermined position and disposed between the handle members and in contact therewith, the first face of the first handle engages the external non-gripping edge of one of the jaws of the second gripping head and the first face of the second handle engages the external non-gripping edge of the other jaw of the second gripping head. With the second gripping head in the normally opened predetermined position and disposed between the handle members and in contact therewith, the second face of the first handle engages the external non-gripping edge of one of the jaws of the first gripping head and the second face of the second handle engages the external non-gripping edge of the other jaw of the first gripping head. Thus, upon moving the first handle member towards the second handle member, the normally open jaws of the first and second gripping heads move towards each other.

A sixth feature is that with the jaws in the normally opened predetermined position, the respective free ends of the handle members are opposed to each other and spaced apart a distance that is no greater than about 6.5 inches, for example, from about 5.0 to about 6.5 inches. The distance between the free ends in both the first position and the second position may be substantially equal. When in this normally opened predetermined position to grip an object, but not gripping an object, the jaws of both heads may be adapted to be pressed together by moving the handle members towards each other. When these jaws are so pressed together, the respective free ends of the handle members are spaced apart a distance at least about 1.75 inch, for example, from about 1.75 to about 3 inches. When the jaws are in a normally opened predetermined position, mid-portions of the handles members may be spaced apart by a distance equal to or less than about 5 inches, regardless of the handle configuration. In other words, even if the handles are non-linear, the mid-portions of the handle members may be spaced apart by a distance equal to or less than about 5 inches.

A seventh feature is that the number of plate members in a stack may be varied depending of the thickness of the heads of the pliers being manufactured. Consequently, the general configuration of the pair of handle members remains substantially the same regardless of head thickness of the pliers and all that needs to be changed to accommodate this varying thickness is the number of plate members being used. Thus, each handle member comprises a panel and a stack of plate members. The number of plate members in one stack is greater than the number of plate members in the other stack as required to accommodate heads of different thicknesses. In one embodiment, the plate members and the panels all have substantially the same thickness. Either embodiment discussed above may employ this manufacturing technique. A handle member may comprise top and bottom panel or the handle member may only employ a single panel to enable a prospective purchaser to see at least one jaw of the head stored between the handle members.

Based on this feature a novel method of manufacturing dual headed pliers is provided. This method comprises the steps of (a) providing a panel of one handle member with a first stack comprising a first predetermined number of plate members, and (b) providing a panel of the other handle member with a second stack comprising a predetermined number of plate members greater then said first predetermined number.

Each plate member has a thickness substantially equal to the thickness of the panels. This method enables using metal sheet material of the same thickness to manufacture several different types of handles for dual headed pliers with different head thicknesses. The thickness of the handle, from about ¼ to 1 inch, will vary depending on the thickness of the head. The number of plate members used is selected based of the head thicknesses of the type of pliers being manufactured.

These features are not listed in any rank order nor is this list intended to be exhaustive.

DESCRIPTION OF DRAWING

Some embodiments of this invention, illustrating all its features, will now be discussed in detail. These embodiments depict the novel and non-obvious dual-headed pliers of this invention as shown in the accompanying drawing, which is for illustrative purposes only. This drawing includes the following Figures (Figs.), with like numerals indicating like parts:

FIG. 4A is a side view of the dual-headed pliers taken along line 4A—4A of FIG. 4.

FIG. 4B is a side view of the dual-headed pliers taken along line 4B—4B of FIG. 4.

DETAILED DESCRIPTION OF SOME EMBODIMENTS OF THIS INVENTION

Figure 4:
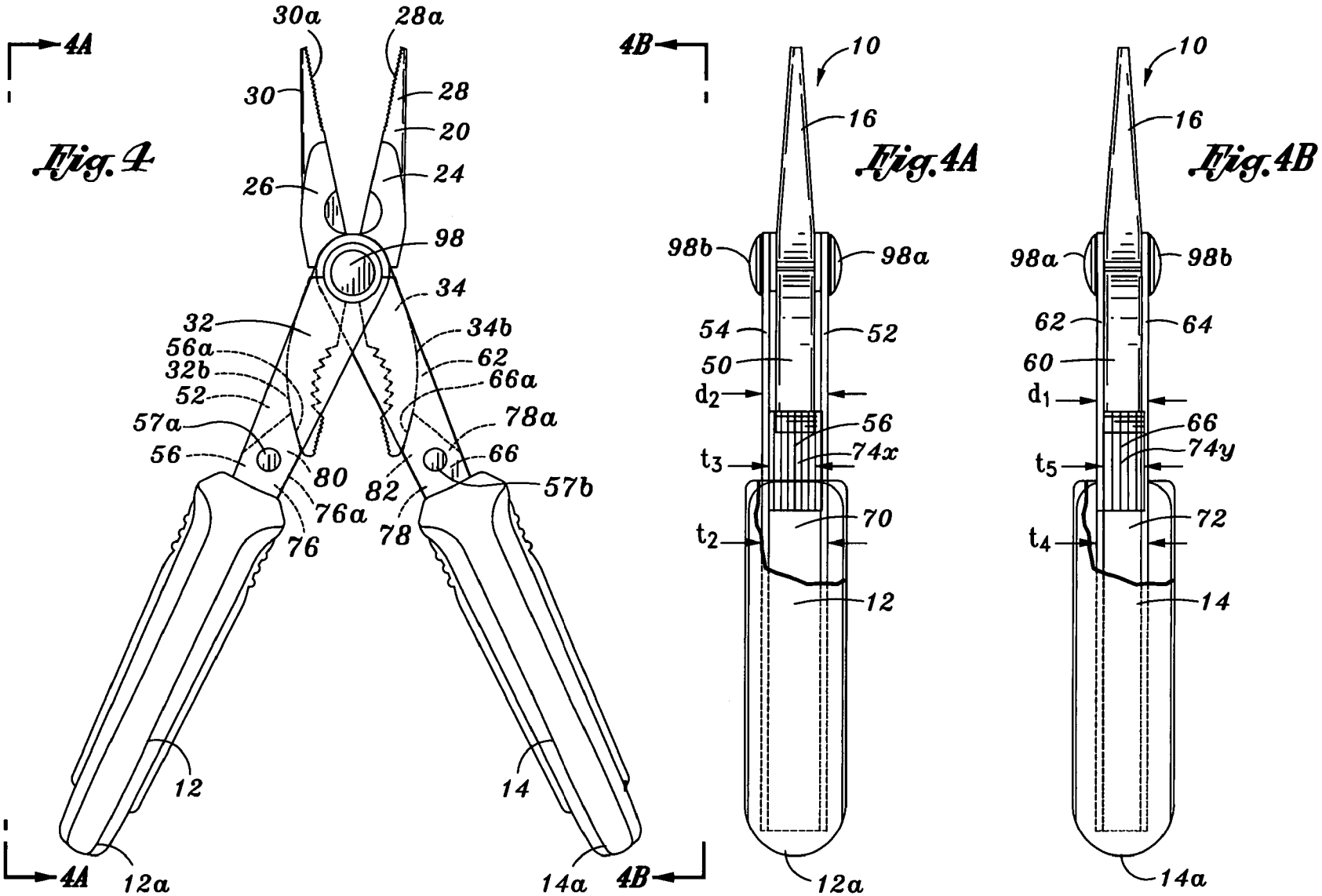
FIG. 4 is a plan view of the dual-headed pliers shown in FIG. 1.
Figure 5:
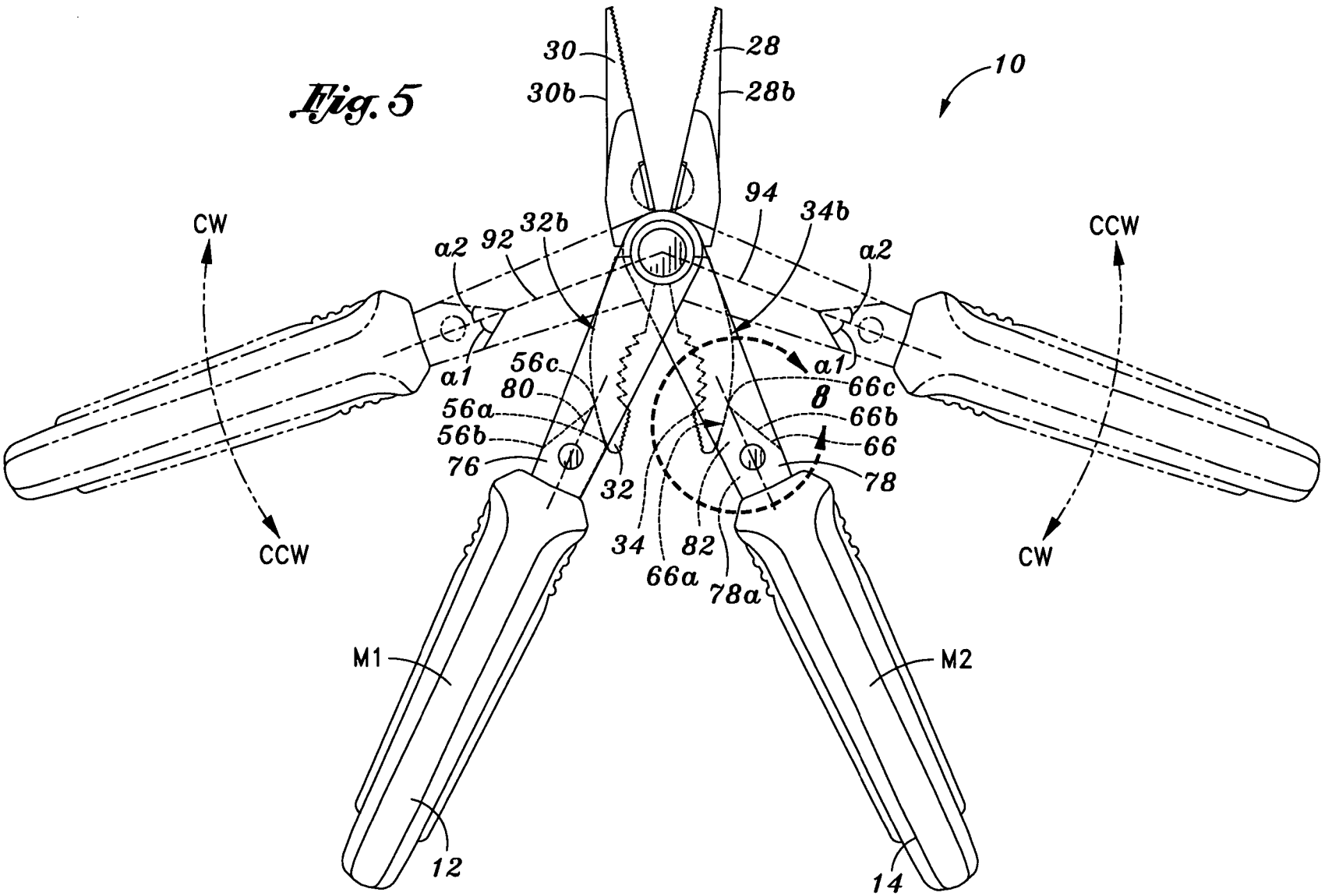
FIG. 5 is a plan view of the dual-headed pliers illustrating movement between a needle-nose head, grip-ready position shown in FIG. 4 and a blunt-nose head, grip-ready position shown in FIG. 6.
Figure 7:
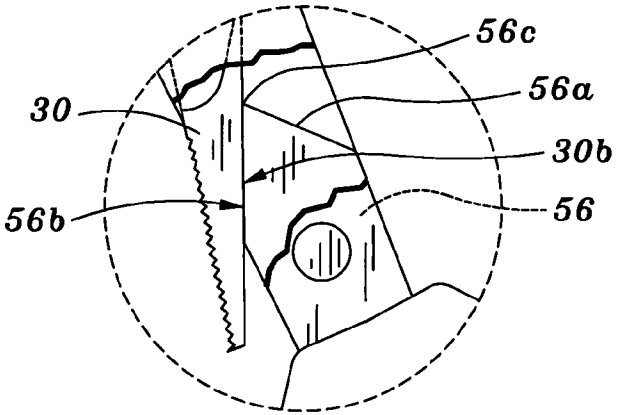
FIG. 7 is an enlarged fragmentary view, with a portion of a panel broken away, taken along line 7 of FIG. 6.
Figure 8:
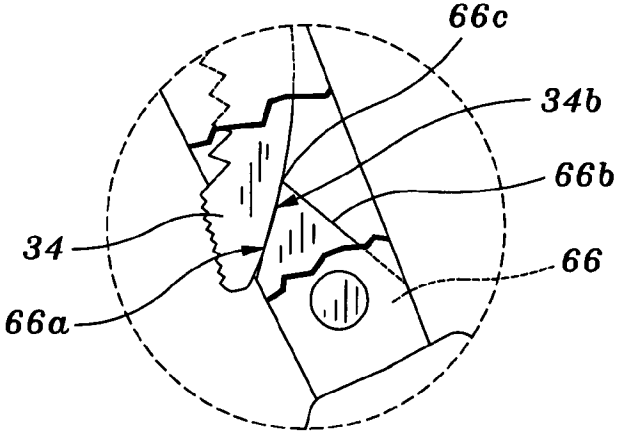
FIG. 8 is an enlarged fragmentary view, with a portion of a panel broken away, taken along line 8 of FIG. 5.
Figure 6:
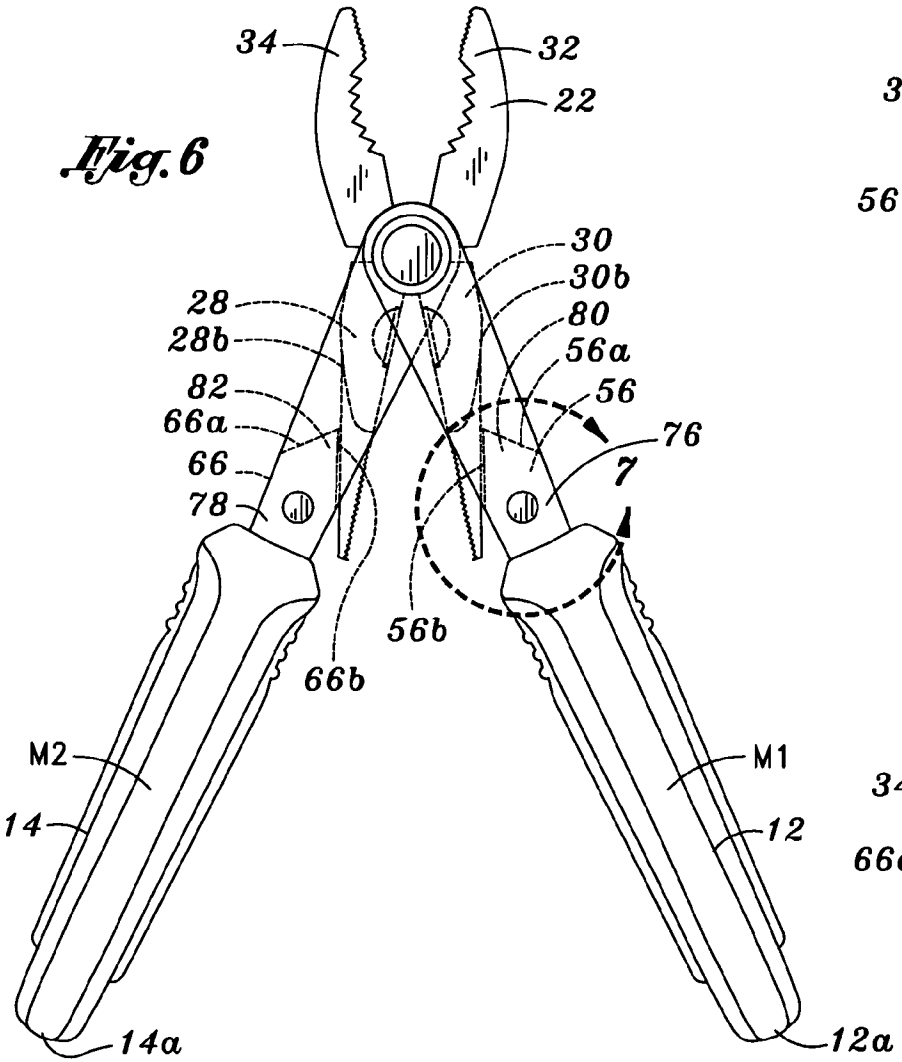
FIG. 6 is a plan view of the dual-headed pliers in a blunt-nose head, grip-ready position.
Figure 9A:
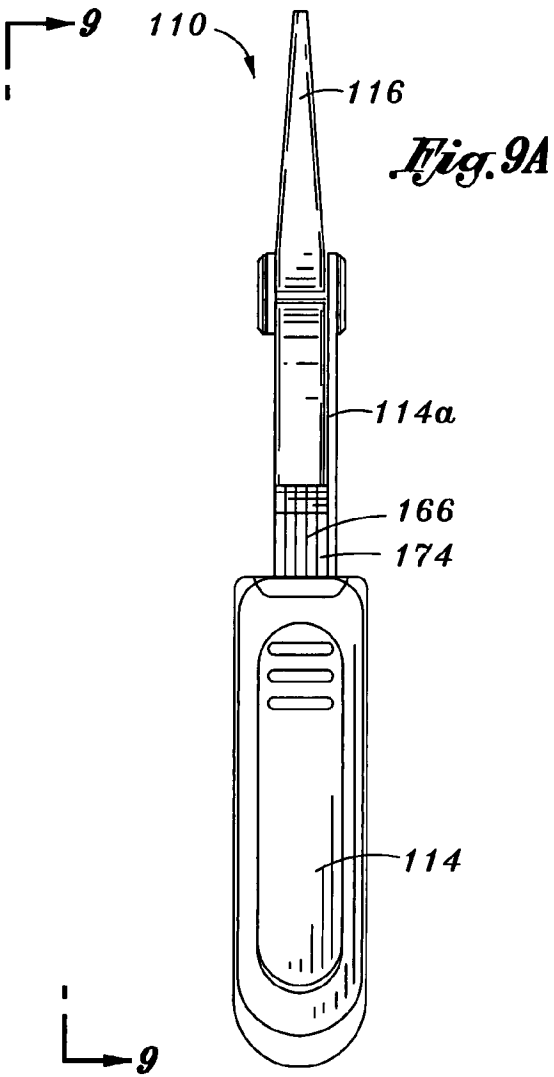
FIG. 9A is a side view of the dual-head pliers shown in FIG. 9 taken along line 9A—9A of FIG. 9.
Figure 9:
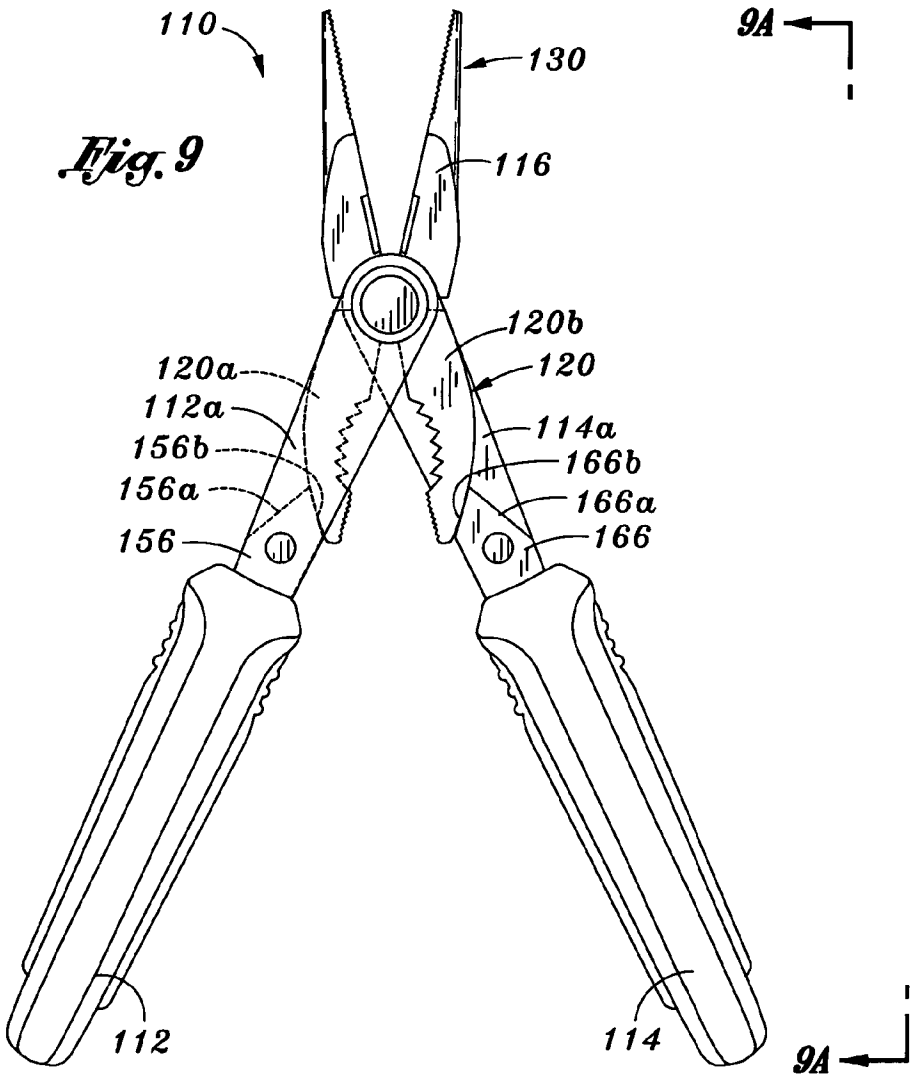
FIG. 9 is a plan view taken along line 9—9 of FIG. 9A of dual-head pliers in a needle-nose head, grip-ready position having handles with a single panel, according to one alternate embodiment of this invention.
Figure 10B:
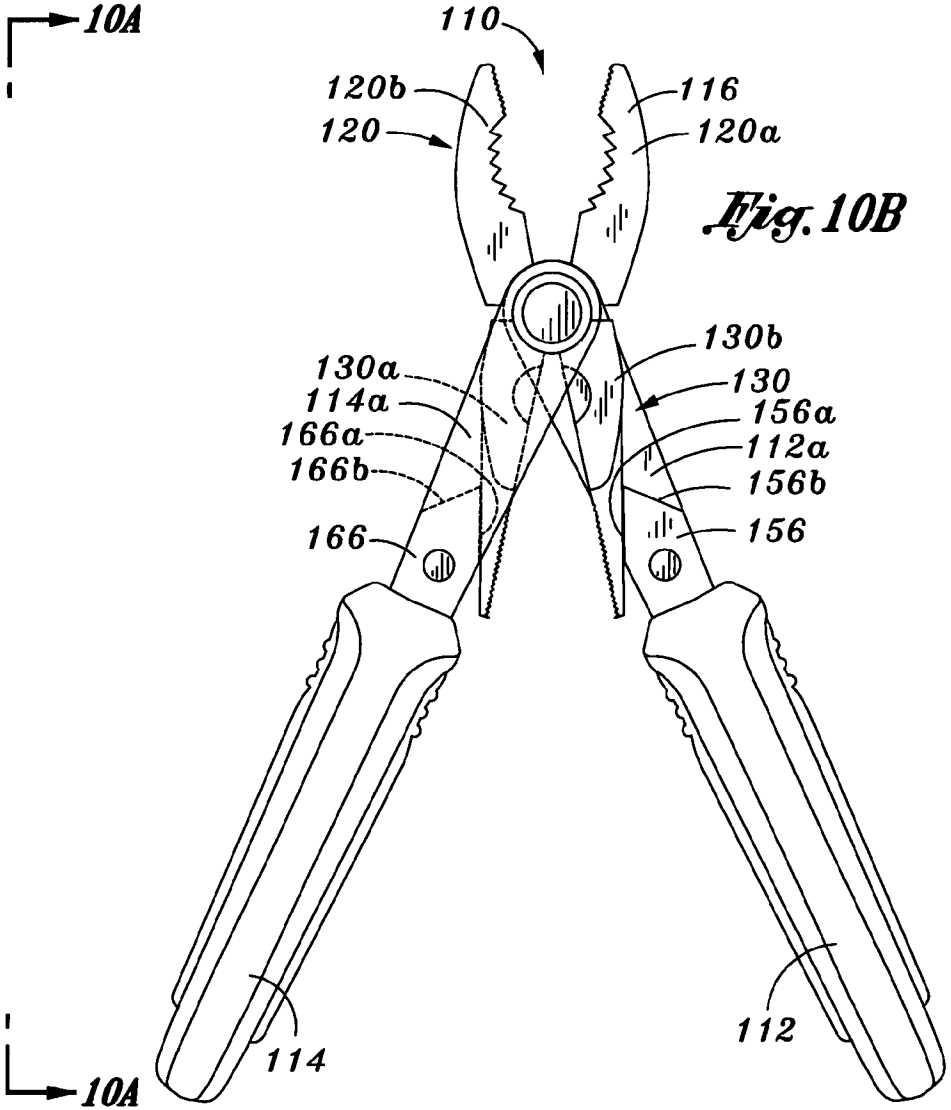
FIG. 10B is a plan view of the dual-headed pliers shown in FIG. 9 in a blunt-nose head, grip-ready, normally open position.
Figure 12:
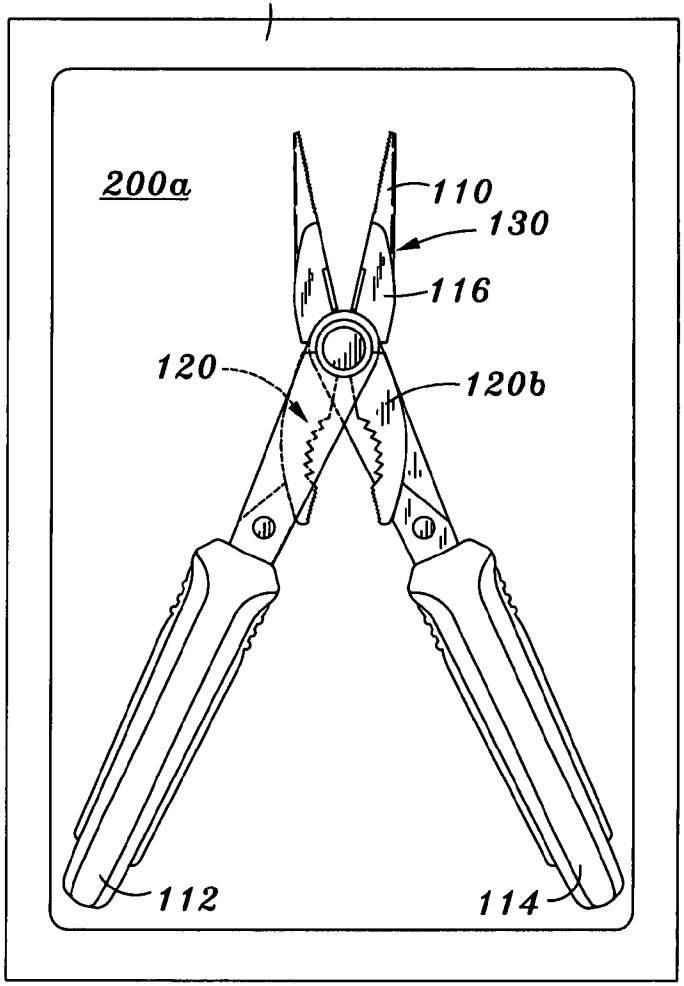
FIG. 12 is a plan view of the dual-headed pliers shown in FIG. 9 encased in packaging.

FIGS. 1 through 8 illustrate one embodiment of this invention, the dual-headed pliers 10, and FIGS. 9 through 10B illustrate one alternate embodiment of this invention, the dual-headed pliers 110. In both embodiments, two different pliers heads are provided, a blunt nose head and a needle nose head. In the pliers 10, manipulation of the handles by the user moves the blunt nose head from a non-operable position (FIG. 4) between the handles to an operable position (FIG. 6). In the pliers 110, manipulation of the handles by the user moves the blunt nose head from a non-operable position (FIG. 9) between the handles to an operable position (FIG. 10B). As discussed subsequently in greater detail, the main difference between these two embodiments is the design of the handles. As best shown in FIG. 12, in the dual-headed pliers 110, its handles have a panel removed, or broken away, so at least a portion of the one head that is not being used and is seated within its handles is visible.

Figure 1:
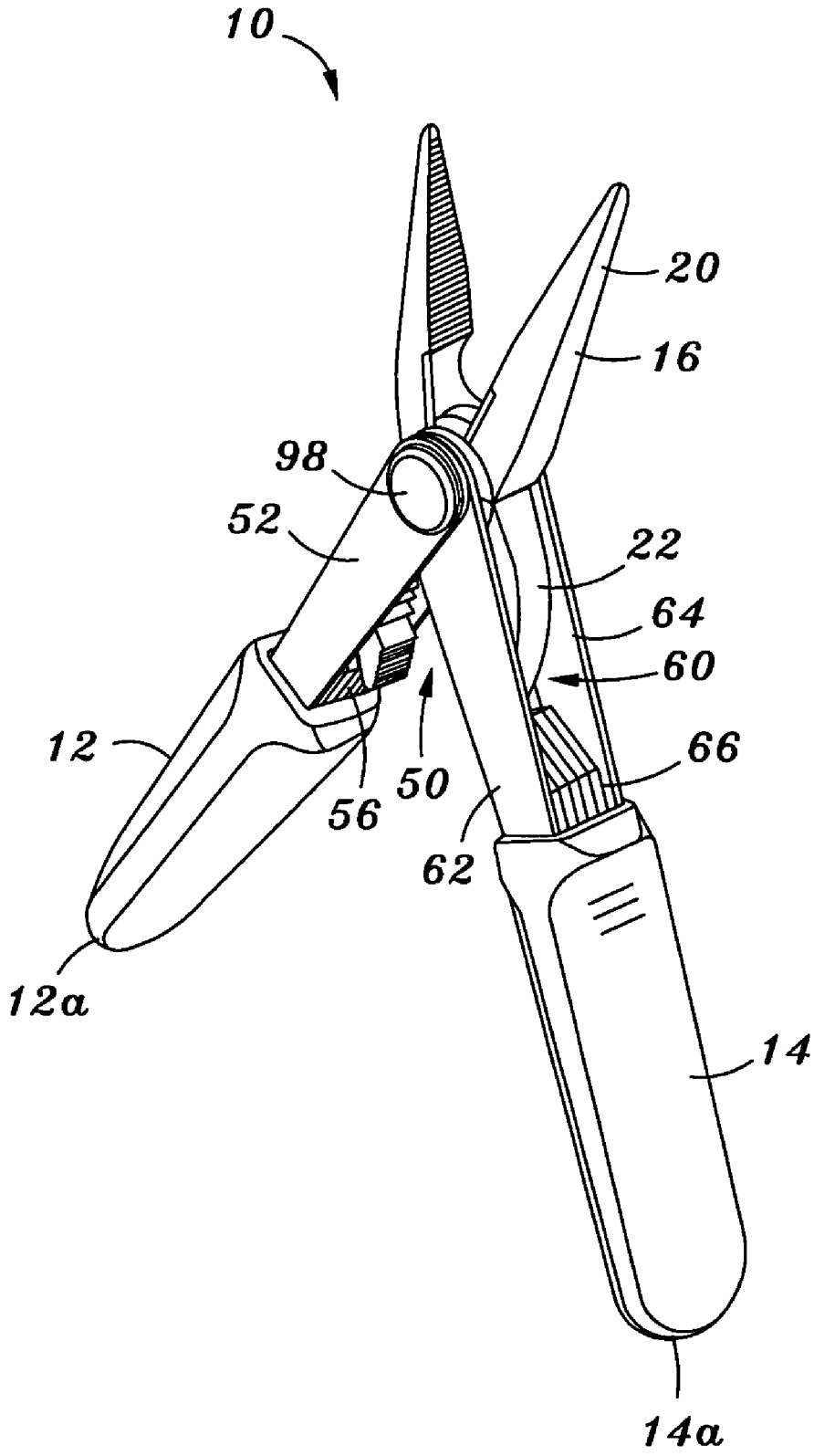
FIG. 1 is a perspective view of the dual-headed pliers in a needle-nose head, grip-ready position according to one embodiment of this invention
Figure 2:
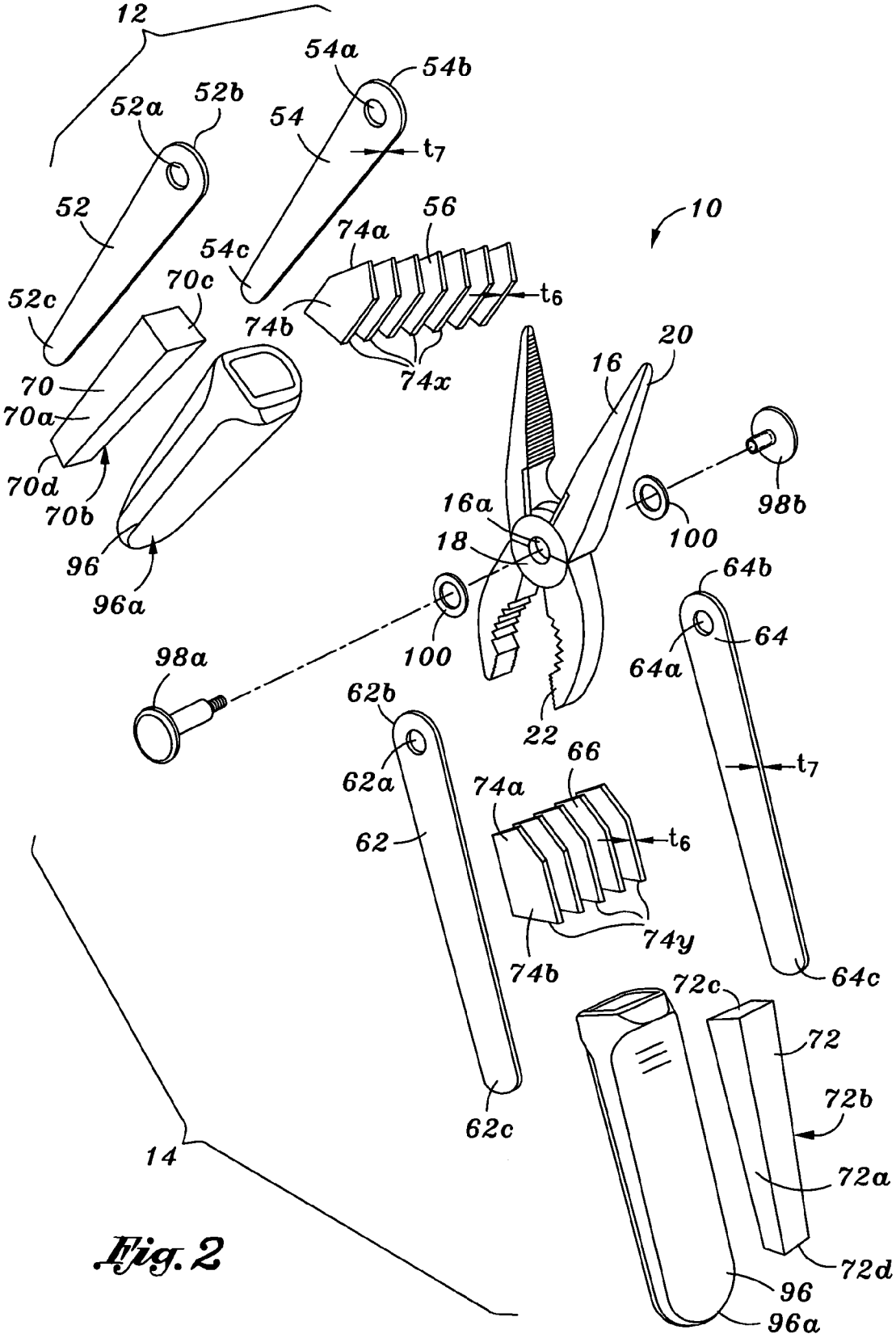
FIG. 2 is an exploded perspective view of the dual-headed pliers shown in FIG. 1.

As best shown in FIGS. 1 and 2, the dual-headed pliers 10 includes a pair of handles 12 and 14 and a pair of gripping heads 20 and 22 attached to the handles. The gripping head 22 is a blunt-nose head and the other gripping head 20 is a needle-nose head. The handles 12 and 14 are manipulated by a user between one position (FIG. 6) where the blunt-nose head 22 is in a grip-ready position and in another position (FIG. 4) where the needle-nose head 20 is in a grip-ready position.

Figure 3A:
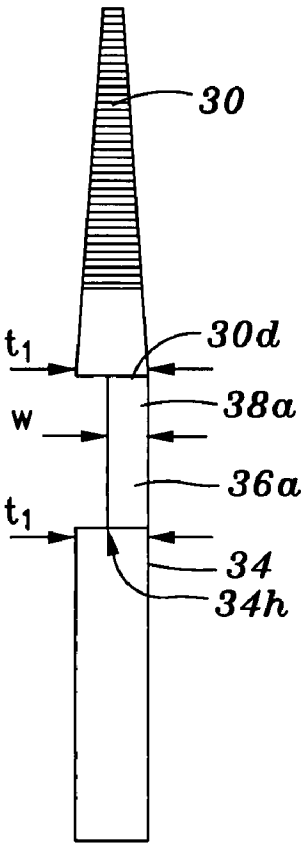
FIG. 3A is a side view of an elongated member taken along line 3A—3A of FIG. 3.
Figure 3:
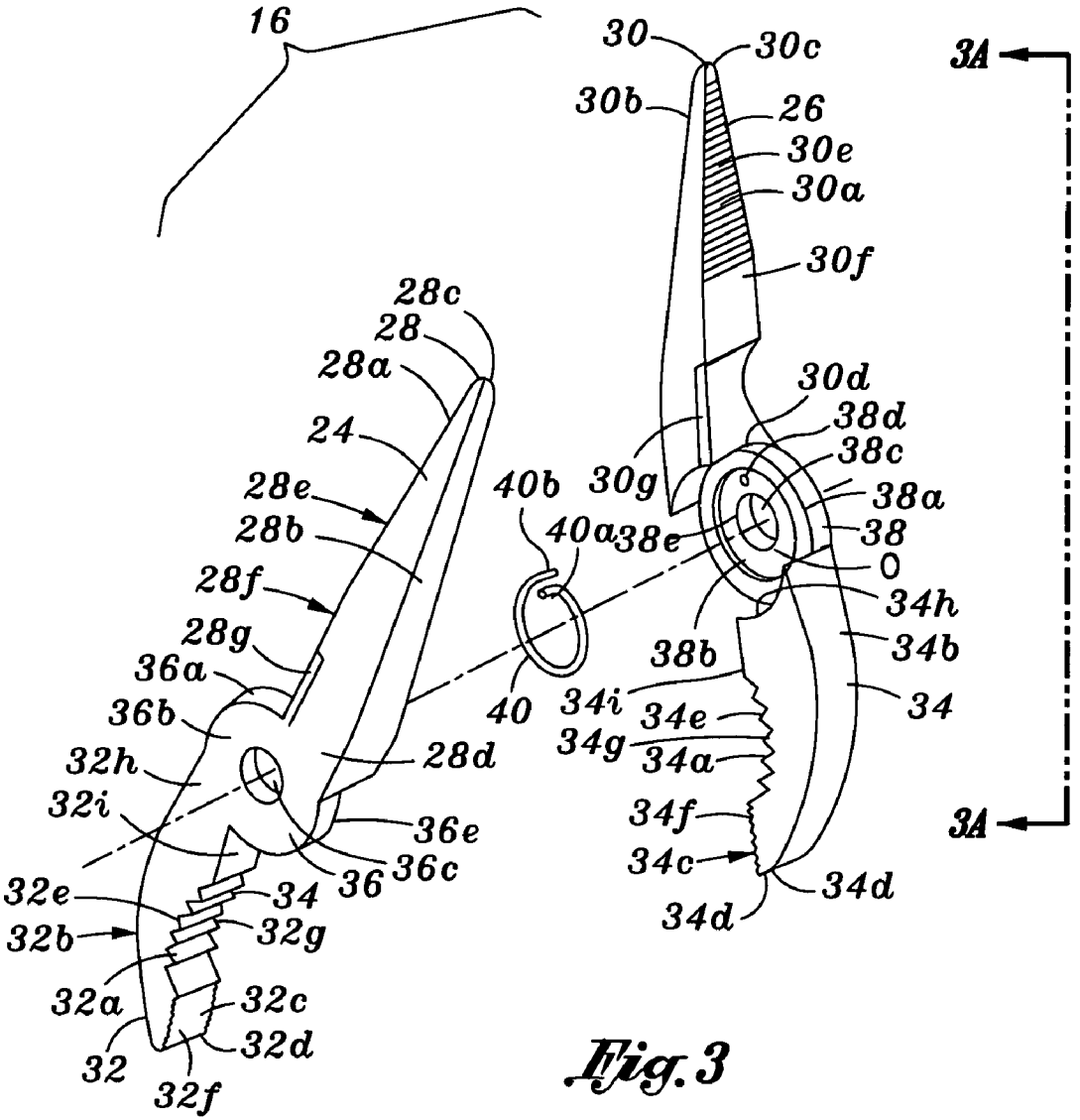
FIG. 3 is an exploded perspective view of the head assembly shown in FIG. 2.

As best shown in FIG. 3, the pair of gripping heads 20, 22 is part of a head assembly 16 that includes the needle-nose head 20 and the blunt-nose head 22, with each head lying opposed to the other. The head assembly 16 is formed from a pair of elongated members 24 and 26. Each elongated member 24, 26 has a needle nose jaw 28, 30 and a blunt nose jaw 32, 34 extending outward from a central, connecting portion 36, 38, respectively. Each needle nose jaw 28, 30 has a substantially triangularly shaped body having an inner, gripping edge 28*a*, 30*a*, an outer non-gripping edge 28*b*, 30*b*, and an outer end 28*c*, 30*c* that is narrower than an inner end 28*d*, 30*d*, respectively. Each gripping edge 28*a*, 30*a* has a plurality of laterally, orientated grooves 28*e*, 30*e* extending from the outer end outer end 28*c*, 30*c* to a smooth portion 28*f*, 30*f*, and a bladed portion 28*g*, 30*g* extending from the central, connecting portion 36, 38 to the smooth portion.

Each blunt-nose jaw 32, 34 has a body with a curved, inner, gripping edge 32*a*, 34*a* and a curved, outer non-gripping edge 32*b*, 34*b*. The inner, gripping edge 32*a*, 34*a* has a flat portion 32*c*, 34*c* extending from an outer end 32*d*, 34*d* to a curved portion 32*e*, 34*e*, and a smooth portion 32*i*, 34*i* extending from the curved portion to the central, connecting portion 36, 38. The flat portions 32*c*, 34*c* and curved portions 32*e*, 34*e* have a plurality of laterally orientated grooves 32*f*, 34*f* and 32*g*, 34*g*, respectively. Each central, connecting portion 36, 38 comprises cylindrical wall 36*a*, 38*a* with a base 36*b*, 38*b* having a circular opening 36*c*, 38*c* about its center and a hole (only 38*d* shown) on the inner side. As best shown in FIG. 3A, the width w of each cylindrical wall 36*a*, 38*a* is substantially half the thickness $t_1$ of the inner ends 32*h*, 34*h* of the needle-nose jaws and blunt nose jaws 28*d*, 30*d*.

The head assembly 16 is formed by aligning the jaws as shown in FIG. 3 and connecting them together to pivot about a fastener 98. The circular openings 36*c* and 38*c* are aligned to form a passageway 16*a* (FIG. 2) through which the fastener 98 passes. The inner sides 36*e*, 38*e* of each central, connecting portion 36, 38 are placed together so the gripping edges 28*a*, 30*a* of the needle-nose jaws 28, 30 and the gripping edges 32*a*, 34*a* of blunt-nose jaws 32, 34 lie opposed to each other, respectively. A circular shaped spring 40 is placed within opposed, circular recessed lands O (only one shown in FIG. 3) in the abutting, central, connecting portions 36, 38. One bent end 40*b* of the spring 40 is inserted into a hole 38*d* in the land O, and another bent end 40*a* of the spring 40 is inserted to a hole (not shown) in the opposed land (not shown) in the connecting portions 36. The spring 40 is normally uncompressed, or in a least compressed state, when the needle-nose jaws 28, 30 or the blunt-nose jaws 32, 34 are positioned in a normally open grip-ready position as shown in FIG. 4 or 6. The spring 40 is compressed when the user grips the handles 12 and 14 and presses them together, moving the jaws towards each other.

As best shown in FIGS. 2, 4A, and 4B, each of the handles 12, 14 includes an open section 50, 60, respectively. The section 50 may be defined by a top panel 52 and a bottom panel 54, and the section 60 may be defined by a top panel 62 and a bottom panel 64. The panels 52 and 54 are substantially flat and planar and substantially parallel to each other, and the panels 62 and 64 are substantially flat and planar and substantially parallel to each other. Each panel 52, 54, 62, 64 has a rounded, connector end 52*b*, 54*b*, 62*b*, 64*b*, respectively, and a free end 52*c*, 54*c*, 62*c*, 64*c*, respectively. There is a hole 52*a*, 54*a*, 62*a*, 64*a* nearby each connector end 52*b*, 54*b*, 62*b*, 64*b*, respectively. Each panel 52, 54, 62, 64 tapers inward from its respective connector end to its respective free end. Each handle 12 and 14 has a length that is from about 4.5 to about 8 inches and each handle may be of equal length. As shown in FIGS. 4A and 4B, the distance $d_2$ between the top panel 52 and bottom panel 54 of handle 12 is greater than the distance $d_1$ between the top panel 62 and bottom panel 64 of handle 12.

As best illustrated in FIG. 4A, situated between the spaced apart panels 52 and 54 of the handle 12 is a block 70 and a stop member 56. And as illustrated in FIG. 4B, situated between the spaced apart panels 62 and 64 of the handle 14 is a block 72 and a stop member 66. Each block 70, 72 has a substantially rectangular cross-sectional shape and extends from one free end 52*c*, 54*c*, 62*c*, 64*c* of each panel 52, 54, 62, 64, respectively, to the stop members 56, 66, respectively. Each stop member 56, 66 abuts the one side 70*c*, 72*c* of each block 70, 72, respectively. The width of each block 70, 72 tapers inwardly from one end 70*c*, 72*c* to a free end 70*d*, 72*d*, and its inwardly tapering width conforms to the inwardly tapering width of each panel portion that it abuts. Consequently, the sides 70*a*, 70*b*, 72*a*, 72*b*, of each block 70, 72 are substantially flush with edges of each panel 52, 54, 62, 64, respectively. As shown in FIG. 4A, the thickness $t_2$ of the block 70 is substantially equal to the thickness $t_3$ of the stop member 56 which it abuts. As shown in FIG. 4B, the thickness $t_4$ of the block 72 is substantially equal to the thickness $t_5$ of the stop member 66 which it abuts The stop member 56 comprises five (5) plates 74*x* that are each aligned and stacked together, and the stop member 66 comprises seven (7) plates 74*y* that are each aligned and stacked together. All the plates 74*x* and plates 74*y* are identical in shape, but are mirror images of each other upon stacking together to form the stop members 56 and 66. The stop members 56 and 66 are respectively secured at intermediate portions of each handle by passing a pin 57*a* through the stacked plates 74*x* and aligned panels 52 and 54 and passing a pin 57*b* and through the stacked plates 74*y* and aligned panels 62 and 64. The plates 74*x* and 74*y* are planar elements and each plate has the shape of a five-sided polygon with a two-sided angular section 74*a* (FIG. 2) extending outward from a three-sided base section 74*b* (FIG. 2). Each plate 74*x* and 74*y* has the same thickness $t_6$, about 1/16 inch. The thickness $t_7$ of each of the panels 52, 54, 62, 64 and the thickness $t_6$ of an individual plate 74*x* or 74*y* are all substantially equal. The difference in the number of plates forming the stop members 56 and 66 is due to the overlapping of the panels connector ends of the handles 12 and 14. The connector ends 62*b* and 64*b* of the panels 62 and 64 are between the connector ends 52*b* and 54*b* of the panels 52 and 54 at the fastener 98. Consequently, the thickness of the outer handle member 12 is greater than the thickness of the inner handle 14 by the thickness of two (2) plates.

As depicted in FIG. 5, the stack of five identical individual plates 74*x* forming the stop member 56 provide an angularly-shaped portion 80 that points toward the fastener 98 and has two planar faces 56*a*, 56*b*. The stack of seven identical individual plates 74*y* forming the stop member 66 provide an angularly-shaped portion 82 that points toward the fastener 98 and has two planar faces 66*a*, 66*b*. The faces 56*a*, 56*b* meet at a junction 56*c* to form a corner having an angle from about 30 to about 90°, and the faces 66*a*, 66*b* meet at a junction 66*c* to form a corner having an angle from about 15 to about 75°. One reference line 92 may be drawn along the axis of the handle 12 from the fastener 98 and intersecting the junction 56*c* and another reference line 94 may be drawn along the axis of the handle 14 from the fastener 98 and intersecting the junction 66*c*. In the one embodiment shown, the faces 56*a*, 66*a* lie at an angle $a_1$ of about 30 degrees relative to the reference line 92, and the faces 56*b*, 66*b* lie at an angle $a_2$ of 15 degrees relative to the reference line 94. The faces 56*a* and 66*a* are used as stops for the blunt-nose jaws 32, 34 and the faces 56*b* and 66*b* are used as stops for the needle-nose jaws 30, 28.

As shown in FIG. 2, a pair of grips 96 enclose an outer portion of each handle 12, 14, covering respectively the blocks 70, 72, a portion of each stop member 56, 66, and a portion of each of the panels 52, 54, 62, 64, including their free ends 52*c*, 54*c*, 62*c*, 64*c*. Each grip 96 is close-ended on its outer side 96*a*, and each grip extends between fifty to seventy percent along the length of the panels 52, 54, 62, 64. The grips 96 are constructed of a non-slippery material such as rubber and are slid over the free ends 52*c*, 54*c*, 62*c*, 64*c* of the handles.

The pliers 10 has a low cost and is easy to assemble. After the head assembly 16 and individual handle assemblies 12 and 14 are made, they are assembled together. Because the panels and plates are of the same thickness, they may all be made from the same sheet of metal material such as steel, for example, by a stamping operation, thereby reducing cost. The panels 52, 54, 62, 64 and the planar elements 74 are formed from sheets of metal where each metal sheet has substantially identical thicknesses. A cutting pattern is formed in the sheet of metal where the pattern includes outlines for the panels 52, 54, 62, 64 and the plates 74*x* and 74*y*.

As best shown in FIG. 2, the head assembly 16 is pivotably attached to the handles 12, 14 by placing the respective pairs of panels 52 and 54 and the panels 62 and 64 in an overlying relationship, aligning the holes 52*a* and 54*a* with holes 62*a* and 64*a* and the passageway 16*a*, and passing the fastener 98 between these holes and the passageway. The fastener 98 may include a male member 98*a* engaging a female member 98*b*. A pair of washers 100 may be placed on opposed sides of the head assembly 16. The grips 96 are then slid over the handles 12 and 14.

As discussed previously, the handles 12 and 14 are manipulated by a user between one position where the blunt-nose head 22 is in a grip-ready position (FIG. 6), and in another position where the needle-nose head 20 is in a grip-ready position (FIG. 4). As FIG. 6 shows, in the blunt-nose head, grip-ready position, the faces 56*b*, 66*b* respectively of the stop members 56 and 66 abut the non-gripping edges 30*b* and 28*b* of needle-nose jaws 30 and 28. These faces 56*b* and 66*b* slope in the same general direction. As FIG. 4 shows, in the needle-nose head, grip-ready position, the faces 56*a* and 66*a* of the stop members 56 and 66 abut the non-gripping sides 32*b* and 34*b* of blunt-nose jaws 32 and 34, and slopes in the same general direction, respectively. In either grip-ready position, the free ends 12*a* and 14*a* of the handles 12 and 14 may be spaced apart by a distance equal to or less than six inches, for example, from about 5 to about 6 inches. Mid-portions M1 and M2 of the handles 12 and 14 may be spaced apart by a distance equal to or less than about 5 inches.

FIG. 5 illustrates the movement of the handles 12 and 14 positioning the jaws between the needle-nose head ready position (FIG. 4) and the blunt-nose head ready position (FIG. 6). As viewed in FIG. 5, to move from the needle-nose head ready position (FIG. 4) to the blunt-nose head ready position (FIG. 6) the user rotates the handle 12 clockwise (cw) and the handle 14 counter-clockwise (ccw), displacing the handles 12 and 14 away from the non-gripping edges 32*b*, 34*b* of the blunt-nose jaws 32 and 34 and moving them towards the needle-nose jaws 30 and 28, respectively. Handle 12 is rotated in a clockwise direction until the face 56*b* of the stop member 56 abuts the non-gripping edge 30*b* of the needle-nose jaw 30 and the handle 14 is rotated in a counter-clockwise direction until the face 66*b* of the stop member 66 abuts the non-gripping edge 28*b* of the needle-nose jaw 28. Similarly, the dual-headed pliers 10 may be moved from the blunt-nose head ready position (FIG. 6) to the needle-nose head ready position (FIG. 4) by rotating each handle 12, 14 away from the non-gripping edges 30*b*, 28*b* of the needle-nose jaws 30 and 28, towards the blunt-nose jaws 32 and 34, respectively.

Figure 11:
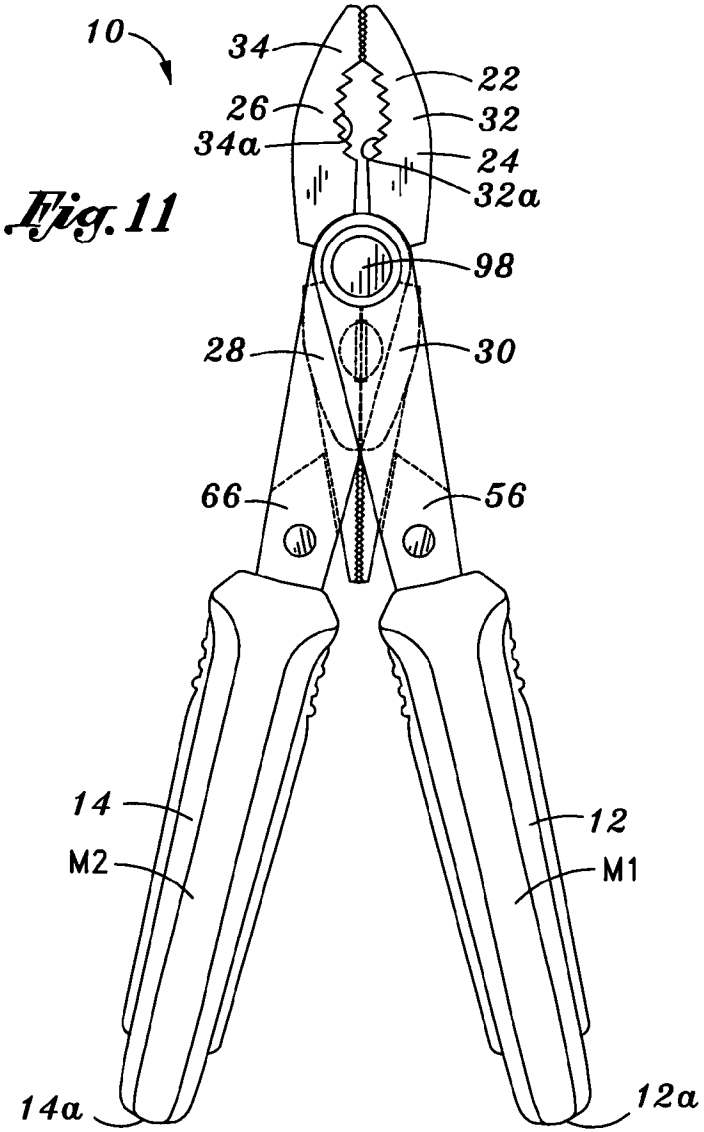
FIG. 11 is a plan view of the dual-headed pliers shown in FIG. 6 in a blunt-nose head completely closed position.
Figure 13:
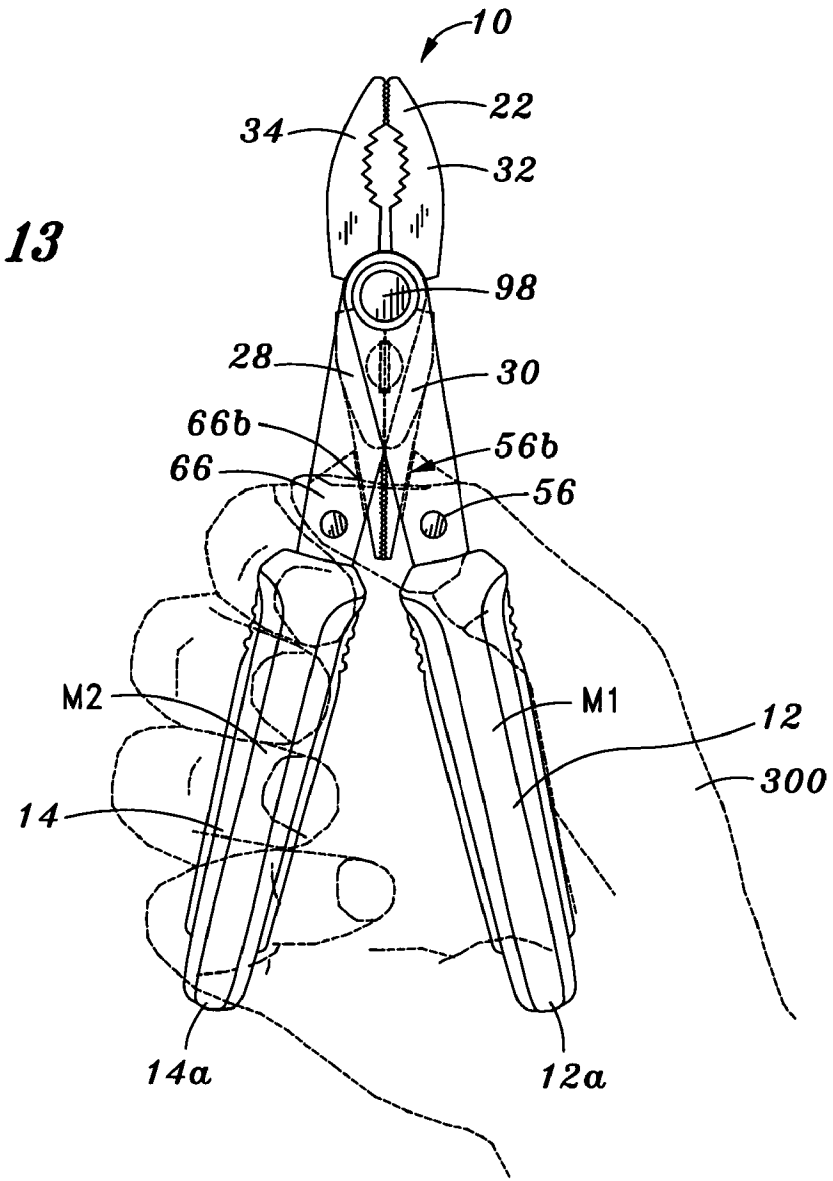
FIG. 13 is a plan view of the dual-headed pliers shown in FIG. 6 in a blunt-nose head completely closed position, illustrating a user squeezing the handles together so the jaws of each head press together.

Referring to FIGS. 11 and 13, with the blunt nose head 22 in a gripping position, a user using his or her hand 300 grips the mid-portions M1 and M2 of the handles 12 and 14 and squeezes the handles towards each other. This causes the elongated members 24 and 26 to rotate about the fastener 98 and move the gripping edges 32*a* and 34*a* of the blunt-nose jaws 32 and 34 towards each other to a completely closed position. The stop members 56 and 66 push the needle-nose jaws 30 and 28 together as the blunt-nose jaws 32 and 34 move toward each other. In the completely closed position shown in FIG. 11, the free ends 12*a* and 14*a* of the handles may be spaced apart from about 1.75 to about 3.00 inches.

To position the needle-nose head 20 for use, as viewed in FIG. 11, the user now rotates the handle 14 clockwise and the handle 12 counter-clockwise to move the needle-nose head 20 into the gripping position shown in FIG. 4. In this needle-nose ready position, a user actuates the needle-nose head 20 by squeezing the handles 12 and 14 towards each other, whereby the stop members 56 and 66 push the blunt-nose jaws 32 and 34 together, causing the elongated members 24 and 26 to rotate about the fastener 98 and moving the gripping edges 28*a* and 30*a* of the needle-nose jaws 28 and 30 towards each other, respectively. The free ends 12*a* and 14*a* of the handles are also spaced apart from about 1.75 to about 3.00 inches when the jaws of the needle-nose head 20 are completely pressed together.

Figure 10A:
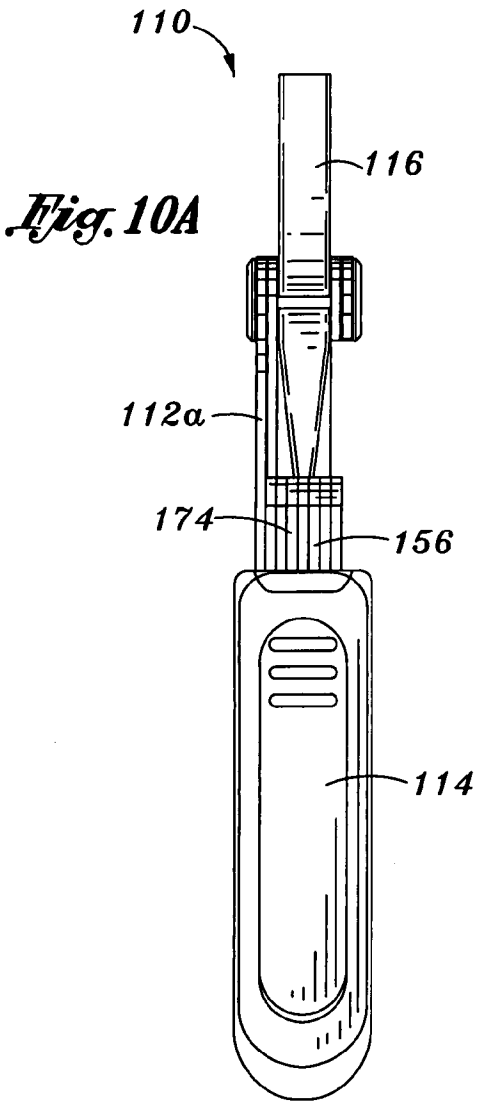
FIG. 10A is a side view of dual-headed pliers shown in FIG. 10B taken along line 10A—10A of FIG. 10B.

FIG. 9 illustrates the one alternate embodiment, the dual-headed pliers 110, where each handle 112, 114 has only a single panel 112*a*, 114*a*, respectively, that is fastened to the head assembly 116. FIGS. 9 and 9A illustrate the dual-head pliers 110 in the needle-nose head ready position, and FIGS. 10 and 10A illustrate the dual-head pliers 110 in the blunt-nose head ready position. In this embodiment, stop members 156 and 166 are similar to the stop members used in the pliers 10, and include a plurality of plates 174 stacked upon each other. The stop member 156 includes the faces 156*a* and 156*b* and the stop member 166 includes the faces 166*a* and 166*b*. These different faces engage blunt-nose head 120 or the needle-nose head 130 as the handles 112 and 114 are moved into different positions in a manner similar to that discussed in connection with the pliers 10. As depicted in FIG. 9, the faces 156*b* and 166*b* engage the jaws 120*a* and 120*b* of the blunt-nose head 120 when the needle-nose head 130 is in an open, grip ready position. As depicted in FIG. 10B, the faces 156*b* and 166*b* engage the jaws 130*b* and 130*a*, respectively, of the needle-nose head 130 when the needle-nose head 130 is in an open, grip ready position.

As depicted in FIGS. 9A and 10A, the single panel 112*a* of the handle 112 and the single panel 114*a* of the handle 114 lie opposite each other. As shown in FIG. 9, the blunt-nose head is between the handles 112 and 114 and the panel 112*a* covers the one jaw 120*a* of the blunt nose head 120 and the other jaw 120*b* is exposed for viewing. As shown in FIG. 10B, the needle nose head 130 is between the handles 112 and 114 and the panel 114*a* covers the one jaw 130*a* of the needle nose head and the other jaw 130*b* is exposed for viewing. In other words, the single panel 112*a*, of the one handle 112 is on an opposite with respect to the single panel 114*a* on the other handle 114.

FIG. 12 illustrates a packaging 200 of sufficient width and height to enclose the dual-headed pliers 110 in the needle-nose head ready position. The packaging 200 has a transparent cover section 200*a* that enables a prospective purchaser to see the entire dual-headed pliers 110. The pliers 110 is located in a position within the packaging where its head assembly 116 is above the handles 112, 114. The packaging 200 may be used to display the dual-headed pliers 110 for sale at a store. While in the packaging 200, the one jaw 120*b* of the blunt-nose head 120 is highly visible. For example, almost two-thirds of the blunt-nose jaw 120*b* may be seen by a prospective purchaser. Consequently, the prospective purchaser will notice that a pair of heads 120 and 130 are provided by this tool. In the embodiment pliers 10 this is not the case, because the jaws of the heads are covered by the handles' panels.

Figure 14:
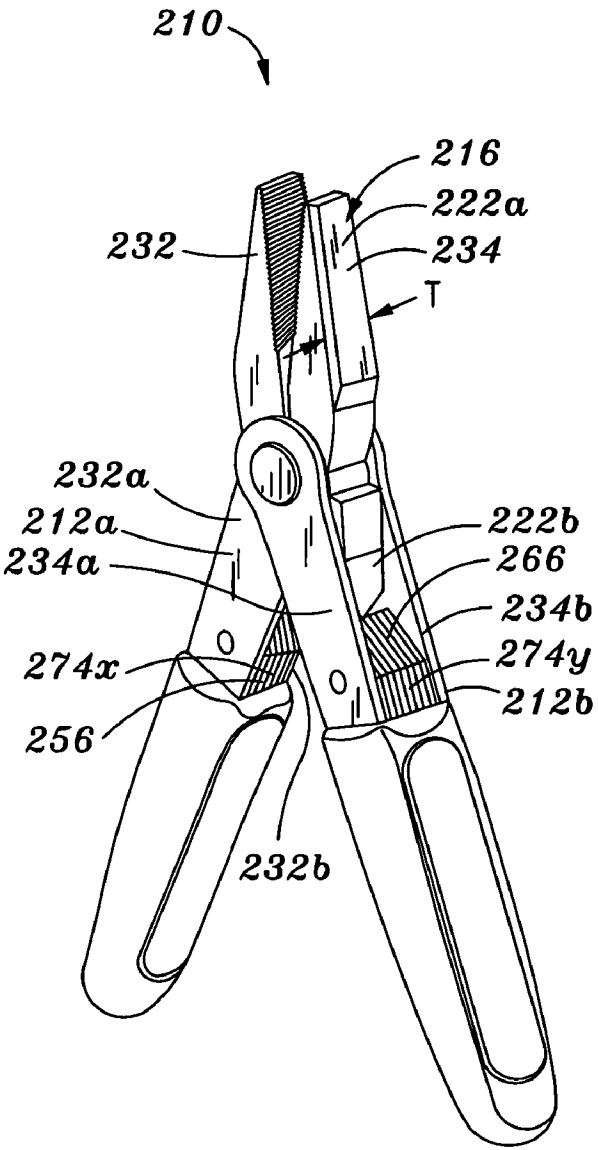
FIG. 14 is another embodiment of this invention showing a thicker pliers head than the other embodiments illustrated to depict the interchangeability of some of the handle components of this invention.

FIG. 14 illustrates an embodiment, the dual-headed pliers 210, having a pliers head assembly 216 that has a thickness T greater than the heads of the other embodiments illustrated. This head assembly 216 also includes a pair of heads 222*a* and 222*b* different in shape than the heads of the other embodiments illustrated. Except for the thickness and shape of the heads 222*a* and 222*b*, the head assembly 216 is constructed and functions in essentially the same manner as discussed above in connection with the other embodiments. Moreover, essentially the same handle design is employed in this embodiment, expect the number of plates is increased to accommodate the increased thickness T of the head assembly 216. Specifically, the dual-headed pliers 210 has one handle 212*a* including a stop member 256 that is a stack of six (6) identical individual plates 274*x* and another handle 212*b* including a stop member 266 that is a stack of eight (8) identical individual plates 274*y*. The plates 274*x* are positioned between a top panel 232*a* and a bottom panel 232*b* and the plates 274*y* are positioned between a top panel 234*a* and a bottom panel 234*b*. The plates 274*a* and 274*y* and the panels 232*a*, 232*b*, 234*a*, and 234*b* all have the same thickness.

Because a stack of plates is employed in accordance with this invention, the number of plates may be increased or decreased to accommodate many different types of head configurations. Consequently, the pliers of this invention may be manufactured at reduced costs because handle thickness may be adjusted for the different individual pliers head thicknesses by simply varying the number of plates in a stack. This method provides a variety head configurations of different shapes and thicknesses with a common handle design, with each handle design having a selected thickness based of the head thickness. To achieve this, all that needs to be changed to make these different head configurations is the number of plates in a stack forming a stop member of a handle.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

The invention claimed is:

1. In an improved dual headed pliers wherein first and second heads are moveable by a pair handle members between a first position where the first head is positioned to grip an object and the second head is between the handle members and a second position where the second head is positioned to grip an object and the first head is between the handle members, each head having opposed jaws and each jaw having an external non-gripping edge, the improvement comprising each handle member including a stop member having first and second substantially planar faces merging at a corner junction along an intermediate portion of each handle member, in the first position the first faces of each stop member of each handle member engage the external non-gripping edges of each jaw of the second head and in the second position the second faces of each stop member of each handle member engage the external non-gripping edges of each jaw of the first head.

2. The pliers of claim 1 where the first and second faces of the stop member of each handle member are surfaces that intersect to form an angle from 30 to 90 degrees.

3. The pliers of claim 1 where the handle members each include a top panel and a bottom panel which are spaced apart and substantially parallel, and the stop member is positioned between the panels, said stop member having one side comprising the first face and another side comprising the second face, said sides being substantially at a right angle to the top and bottom panels.

4. The pliers of claim 3 where the handle members each have a reference line extending between opposed ends, each reference line intersecting the corner junction to form a first acute angle between the first face and the reference line and a second acute angle between the second face and the reference line, said first acute angle being greater then the second acute angle.

5. The pliers of claim 4 where the first faces when engaging individually one of the non-gripping edges of the jaws of the second gripping head, each said first faces slopes substantially in the same general direction as the non-gripping edge which said individual first face engages, and the second faces when engaging individually one of the non-gripping edges of the jaws of the first gripping head, each said second faces slopes substantially in the same general direction as the non-gripping edge which said individual second face engages.

6. The pliers of claim 3 where the handle members each have a line of reference extending between a pivot point about which a handle member rotates and said corner junction, each line of reference intersecting the corner junction to form a first acute angle between the first face and the reference line and a second acute angle between the second face and the reference line, said first acute angle being greater then the second acute angle.

7. A pliers comprising a first gripping head including a first pair of jaws spring biased into a normally opened predetermined position, each jaw of said first pair of jaws having an external non-gripping edge, a second gripping head including a second pair of jaws spring biased into a normally opened predetermined position, each jaw of said second pair of jaws having an external non-gripping edge, a pivot member connecting said first and second heads, first and second handle members each having a free end and a connector end attached to the pivot member to enable each handle member to rotate independently about the pivot member, said first and second handle members each including a first face and a second face, with the second gripping head in the normally opened predetermined position and disposed between the handle members and in contact therewith, the first face of the first handle engages the external non-gripping edge of one of the jaws of the second gripping head and the first face of the second handle engages the external non-gripping edge of the other jaw of the second gripping head, and the respective free ends of the handle members are opposed to each other and spaced apart a distance that is less than 6.5 inches, whereby upon manually pressing together the first and second handle members, the normally open jaws of the first and second gripping heads move towards each other and upon release of the handle members the jaws return to their respective normally open positions, with the first gripping head in the normally opened predetermined position and disposed between the handle members and in contact therewith, the second face of the first handle engages the external non-gripping edge of one of the jaws of the first gripping head and the second face of the second handle engages the external non-gripping edge of the other jaw of the first gripping head, and the respective free ends of the handle members are opposed to each other and spaced apart a distance that is no greater than 6.5 inches, whereby upon manually pressing together the first and second handle members, the normally open jaws of the first and second gripping heads move towards each other and upon release of the handle members the jaws return to their respective normally open positions.

8. The pliers of claim 7 where said distance is from 5.0 to 6.5 inches.

9. The pliers of claim 7 where said the distance between the free ends in both the first position and the second position is substantially equal.

10. The pliers of claim 7 where the handle members each include a top panel, a bottom panel, and a stop member positioned between the panels intermediate the free end and the connector end of each handle member, said stop member having one side comprising the first face and another side comprising the second face.

11. The pliers of claim 10 where the first and second faces of the stop member of each handle member merge at a junction to form a corner.

12. The pliers of claim 11 where the first and second faces of the stop member of each handle member are planar surfaces.

13. The pliers of claim 12 where the handle members each have a reference line extending from the pivot member to the corner junction, the reference line of each handle member intersecting each corner junction to form a first acute angle between the first face and the reference line and a second acute angle between the second face and the reference line, said first acute angle being greater then the second acute angle.

14. The pliers of claim 7 where the first faces of the handle members when engaging individually one of the non-gripping edges of the jaws of the second gripping head, each said first face slopes substantially in the same general direction as the non-gripping edge which said individual first face engages, and the second faces of the handle members when engaging individually one of the non-gripping edges of the jaws of the first gripping head, each said second face slopes substantially in the same general direction as the non-gripping edge which said individual second face engages.

15. The pliers of claim 7 where the jaws of each head when in position to grip an object but not gripping an object are adapted to be pressed together by moving the handle members towards each other, and when said jaws are so pressed together, the respective free ends of the handle members are spaced apart a distance at least 1.75 inch.

16. The pliers of claim 15 where said distance between the free ends when the jaws are pressed together is from 1.75 to 3 inches.

17. The pliers of claim 7 where each handle member has a length that is from 4 to 9 inches and said handle members have substantially equal lengths.

18. A pliers comprising a first gripping head including a first pair of jaws spring biased into a normally opened predetermined position, each jaw of said first pair of jaws having an external non-gripping edge, a second gripping head including a second pair of jaws spring biased into a normally opened predetermined position, each jaw of said second pair of jaws having an external non-gripping edge, a pivot member connecting said first and second heads, first and second handle members each having a free end and a connector end attached to the pivot member to enable each handle member to rotate independently about the pivot member, each handle member including a top panel, a bottom panel, and a stop member positioned between the panels intermediate the free end and the connector end of each handle member, said stop member having one side comprising a first face and another side comprising a second face, and said first and second faces of the stop member of each handle member merging at a junction to form a corner, with the second gripping head in the normally opened predetermined position and disposed between the handle members and in contact therewith, the first face of the first handle engages the external non-gripping edge of one of the jaws of the second gripping head and the first face of the second handle engages the external non-gripping edge of the other jaw of the second gripping head, and the respective free ends of the handle members are opposed to each other and spaced apart a distance from 5.0 to 6.5 inches, whereby upon manually pressing together the first and second handle members, the normally open jaws of the first gripping head move towards each other, with the first gripping head in the normally opened predetermined position and disposed between the handle members and in contact therewith, the second face of the first handle engages the external non-gripping edge of one of the jaws of the first gripping head and the second face of the second handle engages the external non-gripping edge of the other jaw of the first gripping head, and the respective free ends of the handle members are opposed to each other and spaced apart a distance from 5.0 to 6.5 inches, said handle members each having a longitudinal axis intersecting one of said junctions to form a first acute angle between the first face and the longitudinal axis and a second acute angle between the second face and the longitudinal axis, said first acute angle being greater then the second acute angle, said first faces of the handle members when engaging individually one of the non-gripping edges of the jaws of the second gripping head, each said first face sloping substantially in the same general direction as the non-gripping edge which said individual first face engages, and the second faces of the handle members when engaging individually one of the non-gripping edges of the jaws of the first gripping head, each said second face sloping substantially in the same general direction as the non-gripping edge which said individual second face engages, said distance between the free ends being substantially equal in both said first and second positions, whereby upon manually pressing together the first and second handle members, the normally open jaws of the gripping heads move towards each other and upon release of the handle members the jaws return to their respective normally open positions.

19. The pliers of claim 18 where the first and second acute angles are from 15 to 75 degrees.

20. A pliers comprising a first gripping head including a first pair of jaws, each jaw of said first pair of jaws having an external non-gripping edge, a second gripping head including a second pair of jaws, each jaw of said second pair of jaws having an external non-gripping edge, said first and second handle members being pivotally connected and moveable between first and second positions, in the first position the first head is positioned to grip an object and the second head is between the handles, and in the second position the second head is positioned to grip an object and the first head is between the handle members, each handle member having a free end and each including a stop member having one side comprising a first face and another side comprising a second face, in the first position the first faces of each stop member of each handle member engage the external non-gripping edges of each jaw of the second head and in the second position the second faces of each stop member of each handle member engage the external non-gripping edges of each jaw of the first head, in said first and second positions the respective free ends of the handle members are opposed to each other and spaced apart a predetermined distance no greater than 6.5 inches.

21. The pliers of claim 20 where said predetermined distance is from 5 to 6.5 inches and said distance between the free ends is substantially equal in both said first and second positions.

22. The pliers of claim 21 where the pair of jaws of each head have gripping edges that may be pressed together when not gripping an object while in the first position, the respective free ends of the handle members being spaced apart a distance that is greater than 1.75 inch when said gripping edges of a pair of jaws are pressed together.

23. The pliers of claim 22 where each handle member has a length that is from 4 to 9 inches and said handle members have substantially equal lengths.

24. The pliers of claim 20 where the handle members each include a top panel and a bottom panel that are substantially parallel and spaced apart a distance from ¼ to 1 inch, and the stop member is positioned between the panels.

25. The pliers of claim 24 where the first and second faces of the stop member of each handle member are planar surfaces intersecting at an angle from 30 to 90 degrees.

26. The pliers of claim 25 where when engaging individually one of the non-gripping edges of the jaws of the second gripping head, the first faces of each stop member slope in the substantially same general direction as the non-gripping edge which said individual first faces engage, and when engaging individually one of the non-gripping edges of the jaws of the first gripping head, the second faces of each stop member slope in the substantially same general direction as the non-gripping edge which said individual second face engages.

27. The pliers of claim 20 where the jaws of each head are spring biased into a normally opened predetermined position, and the handle members each have mid-portion, said mid-portions being spaced apart by a distance equal to or less than about 5 inches with the jaws in said normally opened predetermined position.

28. A dual headed pliers comprising a pair of pivotally connected handle members, each handle member including an internal stop member comprising a stack of flat planar elements, said stack having a corner comprising first and second planar faces forming an angle from 30 to 90 degrees, first and second heads moveable by the handle members between first and second positions, in the first position the first head is positioned to grip an object and the second head is between the handle members, and in the second position the second head is positioned to grip an object and the first head is between the handle members, each head having opposed jaws that are spring biased into a normally open position and each jaw having an external non-gripping edge, in the first position the first faces of each stop member of each handle member engage the non-gripping edges of each jaw of the second head and in the second position the second faces of each stop member of each handle member engage the external non-gripping edges of each jaw of the first head.

29. The pliers of claim 28 where when engaging individually one of the non-gripping edges of the jaws of the second gripping head, the first faces of each stop member slope in the substantially same general direction as the non-gripping edge which said individual first faces engage, and when engaging individually one of the non-gripping edges of the jaws of the first gripping head, the second faces of each stop member slope in the substantially same general direction as the non-gripping edge which said individual second face engages.

30. The pliers of claim 28 where the handle members each include a top panel and a bottom panel that are substantially parallel and spaced apart a distance from ¼ to 1 inch, and the stop member is positioned between the panels.

31. The pliers of claim 28 where the handle members each have a free end, when the heads are in the first and second positions, said free ends being opposed to each other and spaced apart a distance that is no greater than 6.5 inches.

32. The pliers of claim 30 where said distance between the free ends is substantially equal in both said first and second positions.

33. A pliers comprising a first gripping head including a first pair of jaws spring biased into a normally open position with individual jaws of said first pair separated a distance that is no greater than 2 inches, each jaw of said first pair of jaws having an external non-gripping edge, a second gripping head including a second pair of jaws with individual jaws of said second pair separated a distance that is no greater than 2 inches, each jaw of said second pair of jaws having an external non-gripping edge, first and second substantially linear oriented handle members connected to the heads and moveable between first and second positions, in the first position the first head is positioned to grip an object and the second head is between the handles, and in the second position the second head is positioned to grip an object and the first head is between the handle members, each handle member having a free end and each including a stop member comprising a stack of plate members, each plate member having substantially an identical five sided polygon shaped with one side comprising a first face and another side comprising a second face, each individual stop member being sized, shaped and positioned on each handle member to be a mirror image of the other stop member, in the first position the first faces of each stop member of each handle member engaging the external non-gripping edges of each jaw of the second head and in the second position the second faces of each stop member of each handle member engaging the external non-gripping edges of each jaw of the first head, in said first and second positions the respective free ends of the handle members being opposed to each other and spaced apart a predetermined distance that is no greater than about 6.5 inches.

34. A dual headed pliers comprising first and second heads and first and second handle members attached thereto, said heads being moveable by the handle members between a first position where the first head is positioned to grip an object and the second head is between the first and second handle members and a second position where the second head is positioned to grip an object and the first head is between the first and second handle members, at least one of said handle members having an open segment that enables at least a portion of the head seated between the and first and second handle members to be exposed for viewing.

35. The pliers of claim 34 where each handle member includes only a single panel member, one said single panel member of one handle member being on an opposite side with respect to the single panel member of the other handle member.

36. A dual headed pliers comprising a first pivotally connected handle member including a top panel and a bottom panel which are spaced apart by a first stop member between said top panel and bottom panel, said first stop member comprising a first stack of flat planar elements having substantially the same predetermined thickness, said first stop member having one side comprising a first face and another side comprising a second face, and said top and bottom panels of the first handle member having a thickness that is substantially equal to said predetermined thickness of said flat planar elements of the first stack, a second pivotally connected handle member including a top panel and a bottom panel which are spaced apart by a second stop member between said top panel and bottom panel, said second stop member comprising a second stack of flat planar elements having substantially the same predetermined thickness, said second stop member having one side comprising a first face and another side comprising a second face, and said top and bottom panels of the second handle member having a thickness that is substantially equal to said predetermined thickness of said flat planar elements of the second stack, said first handle member having a portion connected to the second handle member and positioned between the top panel and a bottom panel of said second handle member, the number of planar elements in the second stack being greater than the number of planar elements in the first stack, first and second heads moveable by the handle members between first and second positions, in the first position the first head is positioned to grip an object and the second head is between the handle members, and in the second position the second head is positioned to grip an object and the first head is between the handle members, each head having opposed jaws that are spring biased into a normally open position and each jaw having an external non-gripping edge, in the first position the first faces of each stop member of each handle member engage the non-gripping edges of each jaw of the second head and in the second position the second faces of each stop member of each handle member engage the external non-gripping edges of each jaw of the first head.

37. The pliers of claim 36 where the planar elements and top and bottom panels all have substantially the same thickness.

38. A dual headed pliers comprising first and second heads and first and second handle members attached thereto, said heads being moveable by the handle members between a first position where the first head is positioned to grip an object and the second head is between the first and second handle members and a second position where the second head is positioned to grip an object and the first head is between the first and second handle members, each handle comprising a top panel and a bottom panel separated by a stack of planar elements with the number of planar elements in one stack being greater than the number of planar elements in the other stack, said the planar elements and top and bottom panels all having substantially the same thickness.

* * * * *